US011290828B2

(12) United States Patent
Kvist et al.

(10) Patent No.: US 11,290,828 B2
(45) Date of Patent: Mar. 29, 2022

(54) HEARING DEVICE WITH ANTENNA FUNCTIONALITY IN SUPPORTING STRUCTURE

(71) Applicant: GN HEARING A/S, Ballerup (DK)

(72) Inventors: Søren Helstrup Kvist, Ballerup (DK); Alexandre Da Luz Pinto, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/560,547

(22) Filed: Sep. 4, 2019

(65) Prior Publication Data

US 2020/0100036 A1 Mar. 26, 2020

(30) Foreign Application Priority Data

Sep. 20, 2018 (EP) ..... 18195672

(51) Int. Cl.

| | |
|---|---|
| ***H04R 25/00*** | (2006.01) |
| ***H01Q 1/27*** | (2006.01) |
| ***H01Q 1/38*** | (2006.01) |
| ***H01Q 1/50*** | (2006.01) |

(52) U.S. Cl.

CPC ..... *H04R 25/554* (2013.01); *H01Q 1/273* (2013.01); *H01Q 1/38* (2013.01); *H01Q 1/50* (2013.01); *H04R 2225/51* (2013.01)

(58) Field of Classification Search

CPC combination set(s) only.
See application file for complete search history.

(56) References Cited

U.S. PATENT DOCUMENTS

| | | | | |
|---|---|---|---|---|
| 9,680,209 | B2 | 6/2017 | Oticon et al. | |
| 10,841,716 | B2 * | 11/2020 | Perri | H04R 25/554 |
| 2012/0093324 | A1 | 4/2012 | Sinasi | |
| 2015/0296312 | A1 * | 10/2015 | Nikles | H04R 25/554 381/315 |

FOREIGN PATENT DOCUMENTS

| | | |
|---|---|---|
| EP | 3 316 598 A1 | 5/2018 |
| WO | WO 2005/029918 | 3/2005 |
| WO | WO 2014/090420 A1 | 6/2014 |

OTHER PUBLICATIONS

Extended European Search Report dated Mar. 1, 2019 for corresponding European Application No. 18195672.3.

* cited by examiner

*Primary Examiner* — Angelica M McKinney
(74) *Attorney, Agent, or Firm* — Vista IP Law Group, LLP

(57) ABSTRACT

Disclosed is a hearing device comprising: a microphone configured to receive sound; a processing unit configured to provide a processed audio signal for compensating for a hearing loss of a user; a wireless communication unit configured for wireless communication; a supporting structure; wherein the supporting structure comprises: an electrically conductive ground layer, an electrically non-conductive opening; a connecting line extending from the wireless communication unit provided at a first side of the opening across or along the opening to a second side of the opening and being interconnected with the electrically conductive ground layer at the second side of the opening; wherein the electrically conductive ground layer is configured to be excited by the connecting line, whereby the electrically conductive ground layer is configured to act as antenna for the wireless communication unit for emission and/or reception of an electromagnetic field.

24 Claims, 3 Drawing Sheets

HEARING DEVICE WITH ANTENNA FUNCTIONALITY IN SUPPORTING STRUCTURE

RELATED APPLICATION DATA

This application claims priority to, and the benefit of, European Patent Application No. EP 18195672.3, filed on Sep. 20, 2018. The entire disclosure of the above application is expressly incorporated by reference herein.

FIELD

The present disclosure relates to a hearing device comprising a microphone configured to receive sound, a processing unit configured to provide a processed audio signal for compensating for a hearing loss of a user, a wireless communication unit configured for wireless communication, and a supporting structure, wherein the supporting structure comprises an electrically conductive ground layer.

The hearing device may be used in a binaural hearing device system. During operation, the hearing device is worn in the ear of a user for alleviating a hearing loss of the user.

BACKGROUND

Hearing devices are very small and delicate devices and comprise many electronic and metallic components contained in a housing or shell small enough to fit in the ear canal of a human or be located behind the outer ear. The many electronic and metallic components in combination with the small size of the hearing device housing or shell impose high design constraints on radio frequency antennas to be used in hearing devices with wireless communication capabilities.

Moreover, the antenna in the hearing device must be designed to achieve a satisfactory performance despite these limitations and other narrow design constraints imposed by the size of the hearing device.

The developments within wireless technologies for hearing devices and the continuous efforts to make hearing devices smaller and more cost effective to manufacture has led to the use of flexible carriers incorporating one or more antennas in hearing devices.

Still further, in binaural hearing device systems, the requirements to the quality of the communication between the hearing devices in the binaural hearing device system are ever increasing, and include demands for low latency and low noise, increasing the requests for effective antennas in the hearing devices.

There is a desire to provide radio frequency (RF)-antenna functionality, such as Bluetooth, at low cost and low device complexity.

SUMMARY

It is an object to provide a hearing device with radio frequency (RF)-antenna functionality, such as Bluetooth, at low cost and low device complexity. It is also an object to improve the wireless communication capabilities, such as improved wireless communication capabilities between two hearing devices worn in or behind opposite ears of the user, and/or between a hearing device and an accessory device, such as a smart phone.

Radio connectivity between hearing devices allows for advanced binaural signal processing when the important ear-to-ear (E2E) link is ensured. Furthermore, the hearing devices may be connected to a plethora of accessories, either body-worn or being placed in the user's proximity, and hence to the Internet as part of the so-called Internet-of-things (IoT). However, it is challenging but of key importance to ensure a stable E2E link. The 2.4 GHz ISM (Industrial, Scientific, Medical) band is preferred due to the presence of many harmonized standards for low-power communications, such as Bluetooth Low Energy (BLE) or ZigBee, its worldwide availability for industrial use, and the trade-off between power consumption and achievable range. The E2E link is particularly demanding in terms of requirements on the wearable antenna design and performance. In fact, to achieve a good on-body performance the antenna may exhibit optimal radiation efficiency, bandwidth, polarization, and radiation pattern, while the physical volume available for the design is extremely reduced, as most times space comes at a premium in wearable devices such as hearing devices, in particular in-the-ear (ITE) hearing devices. Furthermore, mass production and industrial design needs provide a desire that the antenna may also be low-profile, lightweight, and inexpensive to manufacture. The antenna polarization characteristic may be an important performance parameter. More overall constrains may also be relevant. In fact, antenna efficiency may be seriously jeopardized by the proximity of the antenna to the human head, as the body tissues have very high losses around 2.4 GHz due to their high water content. This may critically impact the overall performance given the magnitude of the drop-in efficiency and the fact that the hearing device radios operate in an ultra-low-power regime. Another issue threatening antenna efficiency may be the small volume available for the design, as this necessarily brings the antenna in close physical, hence, as well as electromagnetic, proximity of other parts of the device, with a strong likelihood of coupling to them. A large bandwidth is hard to achieve as well for an electrically small antenna (ESA) due to its fundamental limits. The bandwidth may cover at least the whole 2.4 GHz ISM band, but a larger bandwidth may help to compensate for the detuning of the antenna caused by the effects of the body, effects which varies across users.

In accordance with the present disclosure, the above-mentioned and other objects are obtained by the disclosed hearing device.

Disclosed is a hearing device. The hearing device comprises a microphone configured to receive sound. The hearing device comprises a processing unit configured to provide a processed audio signal for compensating for a hearing loss of a user. The hearing device comprises a wireless communication unit configured for wireless communication. The hearing device comprises a supporting structure. The supporting structure comprises an electrically conductive ground layer. The supporting structure comprises an electrically non-conductive opening. The supporting structure comprises a connecting line. The connecting line extends from the wireless communication unit provided at a first side of the opening across or along the opening to a second side of the opening. The connecting line is interconnected with the electrically conductive ground layer at the second side of the opening. The electrically conductive ground layer is configured to be excited by the connecting line, whereby the electrically conductive ground layer is configured to act as antenna for the wireless communication unit for emission and/or reception of an electromagnetic field.

Also disclosed is a method for providing an antenna in a hearing device. The hearing device comprises a microphone configured to receive sound. The hearing device comprises a processing unit configured to provide a processed audio signal for compensating for a hearing loss of a user. The hearing device comprises a wireless communication unit configured for wireless communication. The hearing device comprises a supporting structure. The supporting structure comprises an electrically conductive ground layer. The supporting structure comprises an electrically non-conductive opening. The supporting structure comprises a connecting line. The connecting line extends from the wireless communication unit provided at a first side of the opening across or along the opening to a second side of the opening. The connecting line is interconnected with the electrically conductive ground layer at the second side of the opening. The method comprises exciting the electrically conductive ground layer by the connecting line, whereby the electrically conductive ground layer is configured to act as antenna for the wireless communication unit for emission and/or reception of an electromagnetic field.

The method and apparatus as disclosed provides RF-antenna functionality, such as Bluetooth. The RF-antenna functionality can be made at low cost and low device complexity.

The supporting structure may be a printed circuit board (PCB). It is an advantage that the electrically conductive ground layer, for example being the electrically conductive ground layer in a printed circuit board (PCB), can be excited by the connecting line, and thereby the electrically conductive ground layer can be used as an antenna. The supporting structure comprises an opening, which is electrically non-conductive, for providing the antenna functionality. Furthermore, the connecting line is arranged across or along or through the electrically non-conductive opening for providing the antenna functionality.

The supporting structure, e.g. PCB, may be largely symmetric, and may be folded about a midline when arranged in the hearing device. The antenna may be polarized for optimum on-body performance, such as ear-to-ear and phone-in-the-pocket.

The supporting structure, e.g. PCB, may have a full ground layer throughout, e.g. the electrically conductive ground layer, except in a small portion being the opening, such as a cut-out, e.g. arranged at the center of the electrically conductive ground layer. The size of the opening may be used to tune the antenna impedance.

It is an advantage that the obtained antenna functionality is provided by the electrically conductive ground layer itself, e.g. that the antenna is the electrically conductive ground layer. Thus, no separate antenna unit is required. This saves space in the hearing device, and saves cost when manufacturing the hearing device. Furthermore, the manufacturing of the hearing device may be less complex as no separate antenna needs to be arranged.

The supporting structure may comprise a first layer and a second layer, where the first layer may be the electrically conductive ground layer in which the opening is provided. The second layer may be a full layer without any openings or cut-outs, and the connecting line may be arranged on the second layer. Thus, it is an advantage that the supporting structure, e.g. the first layer and/or the second layer, can be used for routing of signals without decoupling of the signal wires. This also saves extra component costs.

Typically, in prior art, flexible PCB antenna may be used, or sheet metal antennas, or reuse of the RIE wires acting as antenna.

In the disclosure of U.S. Pat. No. 9,680,209, where an electrically conductive ground layer, e.g. in a supporting structure being a PCB, is used as antenna, the following drawbacks have been identified by the inventors of the present disclosure: The antenna polarization in the prior art is opposite of the optimal polarization direction for on-body links, and the solution in the prior art requires a multitude of signal traces to be decoupled. This leads to worse audio performance, due to DC resistance of the decoupling elements in series with microphones and Tele-coil signals, and also leads to larger component costs.

Thus, it is an advantage of the present hearing device that no signal wires are decoupled due to the configuration of the supporting structure, i.e. it is an advantage that the supporting structure comprises an electrically non-conductive opening and a connecting line, where the connecting line extends from the wireless communication unit provided at a first side of the opening across or along the opening to a second side of the opening. The connecting line is interconnected with the electrically conductive ground layer at the second side of the opening. Accordingly, the electrically conductive ground layer is configured to be excited by the connecting line, whereby the electrically conductive ground layer is configured to act as antenna.

It is an advantage that all wires, i.e. signal wires, the connecting line etc., can be on the supporting structure, e.g. on the electrically conductive ground layer, such as a PCB. Furthermore, it is an advantage that no soldering of wires is thereby needed.

It is an advantage that the antenna impedance can be tuned simply by changing the length of the opening in the supporting structure during design.

The supporting structure comprises the connecting line. The connecting line may have a first end and a second end. The first end may be interconnected to the wireless communication unit at the first side of the opening, and the second end may be interconnected with the electrically conductive ground layer at the second side of the opening. The connecting line may be connected with the earth or ground layer at the second side.

The connecting line extends from the wireless communication unit provided at a first side of the opening across or along or through the opening to a second side of the opening.

The connecting line may be a feed line or excitation line or transmission line.

The opening may be a cut-out. The opening may be an indentation. The opening may be in the electrically conductive ground layer. The opening may be shaped as a rectangle or square. The opening may be in an edge of the supporting structure, such as an edge of a longitudinal direction/extension of the supporting structure. The opening may be in a centre of the supporting structure, such that the opening is surrounded by the electrically conductive ground layer all the way around.

The opening may be less than about 30% of the area of the supporting structure, such as less than about 25%, less than about 20%, less than about 15% or less than about 10% of the area of the supporting structure.

The opening may be more than about 10% of the area of the supporting structure, such as more than about 15%, more than about 20%, more than about 25% or more than about 30% of the area of the supporting structure.

The connecting line may be arranged in the centre of the opening.

The connecting line may be arranged closer to the electrically conductive ground layer when the opening is in an edge of the supporting structure, i.e. the connecting line may be arranged away from the edge of the supporting structure.

The connecting line has a longitudinal extension. The connecting line may be arranged parallel to an edge, e.g. a longitudinal edge, of the supporting structure. The connecting line may be arranged parallel to an edge of the opening.

The hearing device may be a behind-the-ear (BTE) hearing device. The hearing device may comprise a housing. The features or components of the hearing device may be comprised, provided or arranged in the housing.

The processing unit is configured to process the sound received by the microphone to provide a processed audio signal for compensating a hearing loss of a user. The hearing device may also comprise an output transducer for providing an acoustic output, i.e. the processed audio signal form the processing unit, to an ear of the user wearing the hearing device in or behind or at his/her ear.

The hearing device comprises a wireless communication unit for wireless communication. The wireless communication unit, or radio, may be arranged on the supporting structure, e.g. a printed circuit board.

According to a further aspect, a binaural hearing device system is disclosed comprising a first and a second hearing device as herein disclosed. Thus, both the first and/or second hearing devices may be a hearing device as disclosed above.

The wireless communication between two hearing devices is an advantage as the hearing devices can communicate together, and such that each hearing device does not need to be adjusted manually, but can be adjusted automatically thanks to the wireless communication with the hearing device in the other ear. For example if the user turns his head, for example when he is in a conversation with another person, the ear pointing away from the sound source, e.g. the conversation partner, will receive less sound, and this ear will thus hear less. Normally the user will then turn up the volume of this hearing device. However, with the ear-to-ear technology, the two hearing devices communicate wirelessly with each other and can automatically turn up and down the volume when needed.

The antenna is for emission and/or reception of an electromagnetic field being interconnected with one of the one or more wireless communication units.

It is an advantage that the antenna functionality is obtained by the connecting line exciting the electrically conductive ground layer, since hereby no extra space is required for an antenna, as the electrically conductive ground layer is configured to act as the antenna.

The antenna functionality obtained by the connecting line exciting the electrically conductive ground layer corresponds to an inverted F-antenna, and/or to a dipole antenna.

The antenna may be a 2.4 GHz antenna. The antenna may be configured for radiation in a first frequency range.

The antenna may be configured to operate in the first frequency range, such as at a frequency above 800 MHz, such as at a frequency above 1 GHz, such as at a frequency of 2.4 GHz, such as at a frequency between 1.5 GHz and 3 GHz, during use. Thus, the antenna may be configured for operation in ISM frequency band. The antenna may be any antenna capable of operating at these frequencies, and the antenna may thus be a resonant antenna, such as a dipole antenna, etc. The resonant antenna may have a length of $\lambda/4$ or any multiple thereof, A being the wavelength corresponding to the emitted electromagnetic field.

In present-day communication systems, numerous different communication systems communicate at or about 2.4 GHz, and thus there is also a significant amount of noise in the frequency range at or about 2.4 GHz. It is an advantage that, for some applications for which the noise may be acceptable, for example for data communication, the antenna, such as an electrical antenna, may be used.

The antenna may be configured for data communication at a first bit rate.

The electrically conductive ground layer may be made of solder material such as a solder alloy, e.g. comprising one or more of zinc, tin, silver, copper and lead.

The supporting structure may comprise or may be a printed circuit board. The printed circuit board may have a matching circuit, and/or a balun.

The hearing device may comprise a battery. The battery may be a flat battery, such as a button shaped battery. The battery may be circular. The battery may be a disk-shaped battery. The supporting structure may comprise a first portion (A) and a second portion (B), and the opening may be arranged in a third portion (C) between the first portion (A) and the second portion (B). If the supporting structure is folded inside the hearing device, the first portion (A) and the second portion (B) may be arranged opposite each other. The battery may be arranged between the first portion (A) and the second portion (B), when the supporting structure is folded, and the first portion (A) and the second portion (B) are opposite each other.

The hearing device may be any hearing device, such as a hearing device of the in-the-ear type, such as in-the-canal type, such as completely-in-the-canal type of hearing device, etc., a hearing device of the behind-the-ear type, of the receiver-in-the-ear type of hearing device, etc.

The hearing device comprises one or more wireless communications unit(s) configured for wireless data communication. Each of the one or more wireless communication units may comprise a transmitter, a receiver, a transmitter-receiver pair, such as a transceiver, a radio unit, etc. The one or more wireless communication units may be configured for communication using any protocol as known for a person skilled in the art, including Bluetooth, WLAN standards, manufacturer-specific protocols, such as tailored proximity antenna protocols, such as proprietary protocols, such as low-power wireless communication protocols, RF communication protocols, magnetic induction protocols, etc. The one or more wireless communication units may be configured for communication using same communication protocols, or same type of communication protocols, or the one or more wireless communication units may be configured for communication using different communication protocols.

The processing unit is configured for providing a processed audio signal. The term sound and/or the term acoustic output may be understood to be an audio signal. Thus, the microphone may be configured to receive sound or an audio signal. An output transducer or receiver may be configured to provide or transmit an acoustic output or a processed audio signal, such as the processed audio signal provided by the processing unit. The acoustic output or processed audio signal may be provided or transmitted to an ear of the user wearing the hearing device during use.

In some embodiments, the supporting structure has an effective length L and an effective width W, and wherein the opening is arranged substantially in a centre part of the effective length L of the supporting structure. The effective length may be the actual measured length of the supporting structure. The effective length may be the conductive/electrical length including the battery and/or other components which are connected to or provided in the supporting structure. The supporting structure may have an effective length L along a longitudinal direction of the supporting structure. The supporting structure may have an effective width W along a transverse direction of the supporting structure. The opening is arranged substantially in a centre part of the effective length L of the supporting structure, such as within 20%, 15%, 10% or 5% from the centre part of the supporting structure.

In some embodiments, the supporting structure comprises a feed area at the first side of the opening, where the feed area is interconnected with the wireless communication unit; and wherein the feed area is arranged substantially in the centre part of the effective length L of the supporting structure.

In some embodiments, the opening is arranged at a side or edge part of the supporting structure. In some embodiments the opening is arranged in the centre or middle part of the supporting structure.

In some embodiments, the opening has a length $L_o$, and wherein the impedance of the antenna is configured to be tuned by changing the length $L_o$ and/or by changing a distance z between an edge of the opening and the connecting line.

In some embodiments, the hearing device comprises a housing, and wherein the supporting structure is configured to be folded or bended inside the housing. The supporting structure may be a flexible printed circuit board.

In some embodiments, the supporting structure comprises a first portion (A) and a second portion (B), and wherein the opening is arranged in a third portion (C) between the first portion (A) and the second portion (B), and wherein, when the supporting structure is folded, the first portion (A) and the second portion (B) are arranged opposite each other. The planes of the first and second portion may be opposite each other when the supporting structure is folded. A normal of the first portion and a normal of the second portion may point towards each other when the supporting structure is folded.

In some embodiments, a first part of the electrically conductive ground layer extends at a first side of the opening, and a second part of the electrically conductive ground layer extends at a second side of the opening, wherein the first side is opposite the second side, and wherein a third part of the electrically conductive ground layer extends along a third side of the opening, the third part interconnecting the first part and the second part (B).

In some embodiments, the third portion (C) is configured to be in a direction of an ear-to-ear axis (E2E) when the hearing device is positioned in the intended operational position at an ear of the user.

In some embodiments, the supporting structure is substantially symmetric about a centre part of the effective length L of the supporting structure. In some embodiments, the supporting structure is substantially symmetric about an axis passing through the connecting line and the opening across the width of the supporting structure. The supporting structure may be substantially symmetric about a midpoint of the effective length.

In some embodiments, the antenna is configured to be polarized by the supporting structure for optimum ear-to-ear (E2E) and phone-in-pocket performance. Thus, the supporting structure is configured for forming the polarization of the antenna. The supporting structure may comprise a polarization element for polarizing the antenna. It is an advantage that the polarization of the antenna is configured to be formed or controlled or improved thereby providing ear-to-ear (E2E) capabilities and/or phone-in-pocket capabilities of the hearing device. Thus, it is an advantage that the polarization of the antenna can be formed or controlled or directed, for example such that it is higher in an orthogonal direction or normal to the head of the user or to the surface of the head of the user. The polarization should be directed such that it improves the wireless communication between, for example, two hearing devices arranged in both ears of the user, and/or such that it improves the wireless communication between, for example, a hearing device in an ear of the user and a phone in the user's pocket. The correct polarization of the antenna, e.g. a polarization which is higher in an orthogonal direction to the surface of the head of the user, is an advantage as this is optimal to excite a strong surface wave, i.e. electromagnetic wave, along the body, such as along the face of the user, such as to the other ear of the user, or to a phone or other accessory device in the user's pocket.

The polarization of the antenna corresponds or defines or determines the direction of the electric field or E-field.

In some embodiments, signal wires are arranged on the supporting structure, and wherein the signal wires are routed across the feed area. In some embodiments, the signal wires are routed between the first portion (A) and the second portion (B) of the supporting structure across the third portion (C) between the first portion (A) and the second portion (B). It is an advantage that hereby no decoupling of signal wires is required. This is an advantage, since decoupling leads to worse audio performance.

In some embodiment, the supporting structure is a carrier printed circuit board; and the processing unit and the wireless communication unit are arranged in a hybrid, and the hybrid is carried on the carrier printed circuit board.

In some embodiments, the supporting structure has at least a first layer and a second layer, and wherein the first layer is an electrically conductive layer, such as the electrically conductive ground layer, the first layer extending over the entire supporting structure, such as over at least 75%, such as over at least 80%, such as over at least 90% of the supporting structure, and wherein the wireless communication unit and the connecting line are provided at the second layer.

In some embodiments, the opening is provided in the first layer.

In some embodiments, the opening comprises a cut-out in the supporting structure and/or in a non-conductive part of the first layer.

In some embodiments, the length of the cut-out in the supporting structure corresponds to the length of the non-conductive part of the first layer, or wherein the length of the non-conductive part of the first layer is shorter than the length of the cut-out in the supporting structure, such as 20% or 10% shorter.

In some embodiments, the opening has a length $L_o$ and a width $W_o$, and wherein the connecting line extends along the length $L_o$ of the opening. The length of the opening $L_o$ is in the same direction as the longitudinal direction of the supporting structure. The width $W_o$ of the opening is in the same direction as the transverse direction of the supporting structure.

In some embodiments, the connecting line extends across the opening at a distance z from an edge of the opening.

In some embodiments, the length of the connecting line corresponds to the length of the opening, such as within +/−10%.

In some embodiments, the effective length of the electrically conductive ground layer corresponds to half of the wavelength of the electromagnetic field to be emitted and/or received.

The present disclosure relates to different aspects including the hearing device described above and in the following, and corresponding hearing devices, binaural hearing devices, hearing devices, hearing instruments, systems, methods, devices, uses and/or product means, each yielding one or more of the benefits and advantages described in connection with the first mentioned aspect, and each having one or more embodiments corresponding to the embodiments described in connection with the first mentioned aspect and/or disclosed in the appended claims.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
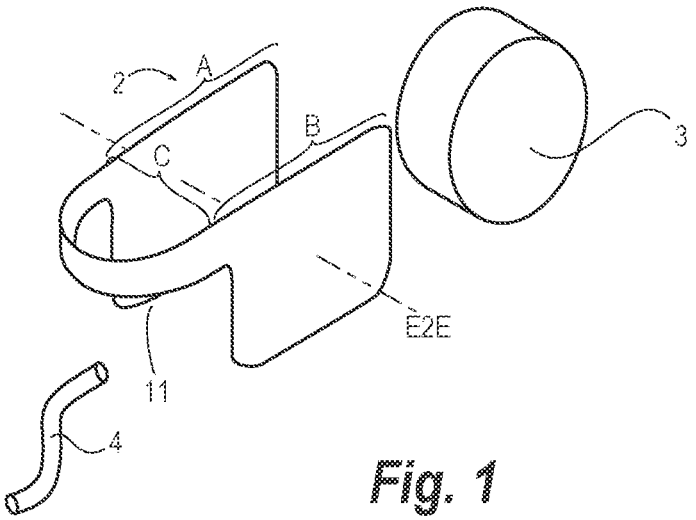
FIG. 1 schematically illustrates an example of components in a hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

Throughout, the same reference numerals are used for identical or corresponding parts.

As used herein, the term "antenna" refers to an electrical device which converts electric power into radio waves. An electric antenna may comprise an electrically conductive material connected to e.g. a wireless communications unit, such as a radio chip, a receiver or a transmitter.

FIG. 1 schematically illustrates an example of components in hearing device. The hearing device comprises an audio tube 4, and a battery 3. The hearing device comprises a supporting structure 2, which may be a flex PCB. The hearing device may comprise a housing, and the supporting structure 2 may be arranged in the housing. The supporting structure 2 is folded or bended when arranged in the hearing device. The ear-to-ear (E2E) axis is shown in the figure. The supporting structure 2 comprises an opening 11. The supporting structure 2 comprises a first portion (A) and a second portion (B). The opening 11, which may be a cut-out, is arranged in a third portion (C) between the first portion (A) and the second portion (B). When the supporting structure 2 is folded to be accommodated in the hearing device, the first portion (A) and the second portion (B) are arranged opposite each other. The third portion part (C) may be configured to be in a direction of the ear-to-ear axis (E2E) when the hearing device is positioned in the intended operational position at an ear of the user.

Figure 2:
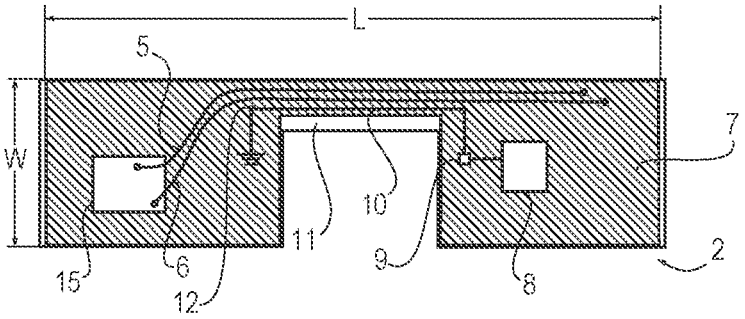
FIG. 2 schematically illustrates an example of a supporting structure for a hearing device.

FIG. 2 schematically illustrates an example of a supporting structure for a hearing device. The supporting structure may be a printed circuit board (PCB). The supporting structure 2 comprises an electrically conductive ground layer 7. The supporting structure 2 comprises an electrically non-conductive opening 11. The opening 11 may be a cut-out or an indentation in the supporting structure 2. The supporting structure 2 comprises a wireless communication unit 8 configured for wireless communication. The supporting structure 2 comprises a connecting line 10. The connecting line 10 extends from the wireless communication unit 8 provided at a first side of the opening 11. The connecting line 10 extends from the wireless communication unit 8 across or along the opening 11 to a second side of the opening 11. The connecting line 10 is interconnected at an interconnection 12, such as connected to ground/earth, with the electrically conductive ground layer 7 at the second side of the opening 11.

The electrically conductive ground layer 7 is configured to be excited by the connecting line 10, whereby the electrically conductive ground layer 7 is configured to act as antenna for the wireless communication unit 8 for emission and/or reception of an electromagnetic field.

The supporting structure 2 has an effective length L and an effective width W. The opening 11 is arranged substantially in a centre part of the effective length L of the supporting structure 2.

The supporting structure 2 comprises a feed area 9 at the first side of the opening 11. The feed area 9 is interconnected with the wireless communication unit 8. The feed area 9 may be arranged substantially in the centre part of the effective length L of the supporting structure 2. The connecting line 10 is connected to the feed area 9.

The opening 11 is arranged at a side/edge part of the supporting structure 2. The opening 11 is arranged in the centre/middle part of the supporting structure 2.

The supporting structure 2 is substantially symmetric about a centre part of the effective length L of the supporting structure 2. The supporting structure 2 is substantially symmetric about an axis passing through the connecting line 10 and the opening 11 across the width of the supporting structure 2.

Signal wires 5, 6 are arranged on the supporting structure 2. The signal wires 5, 6 are routed across the feed area 9. The signal wires 5, 6 are routed in the part of the supporting structure 2 connecting the first side and the second side of the supporting structure. The signal wires 5, 6 are connected to a processing unit 15 in the second side of the supporting structure 2. The signal wires 5, 6 extend from the processing unit 15 in the second side of the supporting structure 2 to the first side of the supporting structure 2.

The signal wires 5, 6 may run parallel to the connecting line 10. The connecting line 10 may be parallel to an edge of the opening 11.

Figure 3:
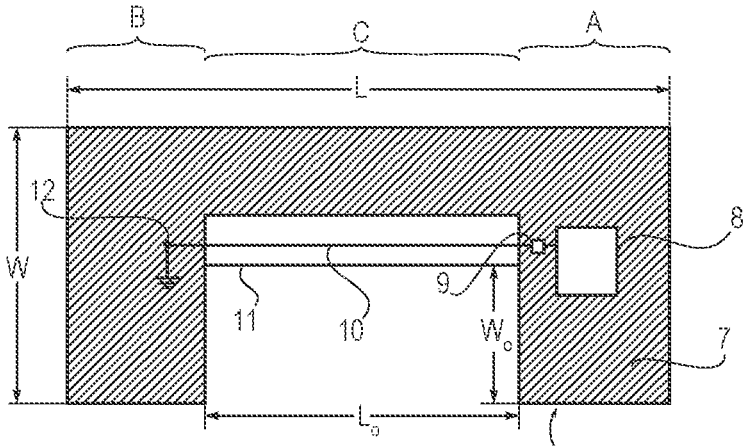
FIG. 3 schematically illustrates an example of a supporting structure for a hearing device.

FIG. 3 schematically illustrates an example of a supporting structure for a hearing device. The supporting structure 2 comprises a first portion (A) and a second portion (B). The supporting structure 2 comprises an opening 11. The opening 11 is arranged in a third portion (C) between the first portion (A) and the second portion (B).

The opening 11 has a length $L_o$ and a width $W_o$. The supporting structure 2 comprises a connecting line 10 which extends along the length $L_o$ of the opening.

The connecting line 10 extends from the wireless communication unit 8 provided at a first side of the opening 11.

The connecting line 10 extends from the wireless communication unit 8 to a second side of the opening 11. The connecting line 10 is interconnected at an interconnection 12, such as connected to ground/earth, via the electrically conductive ground layer 7 at the second side of the opening 11.

The length of the connecting line 10 corresponds to the length $L_o$ of the opening 11, such as within +/−10% of the length.

The size of the opening 11 may be used to tune the antenna impedance. The size of the opening 11 may be defined by the length $L_o$ of the opening 11.

Thus, the impedance of the antenna is configured to be tuned by changing the length $L_o$.

Figure 4:
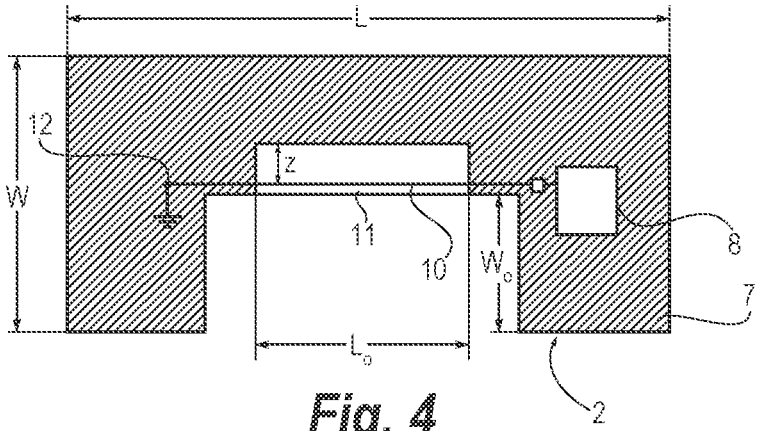
FIG. 4 schematically illustrates an example of a supporting structure for a hearing device.

FIG. 4 schematically illustrates an example of a supporting structure for a hearing device. The supporting structure 2 has a length L and a width W. The supporting structure 2 comprises an opening 11. The opening 11 has a length $L_o$ and a width $W_o$. The supporting structure 2 comprises a connecting line 10 which extends along the length $L_o$ of the opening.

The connecting line 10 extends from the wireless communication unit 8 provided at a first side of the opening 11. The connecting line 10 extends from the wireless communication unit 8 to a second side of the opening 11. The connecting line 10 is interconnected at an interconnection 12, such as connected to ground/earth, via the electrically conductive ground layer 7 at the second side of the opening 11.

The length of the connecting line 10 corresponds to the length of the opening, such as within +/−10% of the length.

The connecting line 10 extends across the opening at a distance z from an edge of the opening 11.

The size of the opening 11 may be used to tune the antenna impedance. The size of the opening 11 may be defined by the length $L_o$ of the opening.

Thus, the impedance of the antenna is configured to be tuned by changing the length $L_o$ and/or by changing the distance z between an edge of the opening 11 and the connecting line (10).

Figure 5:
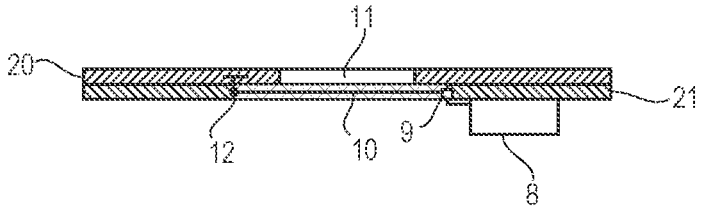
FIG. 5 schematically illustrates an example of a supporting structure for a hearing device.

FIG. 5 schematically illustrates an example of a supporting structure for a hearing device. The supporting structure 2 has at least a first layer 20 and a second layer 21. The first layer 20 is an electrically conductive layer, such as the electrically conductive ground layer 7. The first layer 20 extends over the entire supporting structure 2, such as over at least 75%, such as over at least 80%, such as over at least 90% of the supporting structure 2. The second layer 21 is arranged adjacent to the first layer 20, such as under the first layer 20. The wireless communication unit 8 and the connecting line 10 are provided at the second layer 21.

The opening 11 may be provided in the first layer 20.

The opening 11 may comprise a cut-out in the supporting structure 2 and/or in a non-conductive part of the first layer 20.

The length of the opening 11/cut-out in the supporting structure 2 may correspond to the length of the non-conductive part of the first layer 20. Alternatively, the length of the non-conductive part of the first layer 20 is shorter than the length of the opening 11/cut-out in the supporting structure 2.

Figure 6:
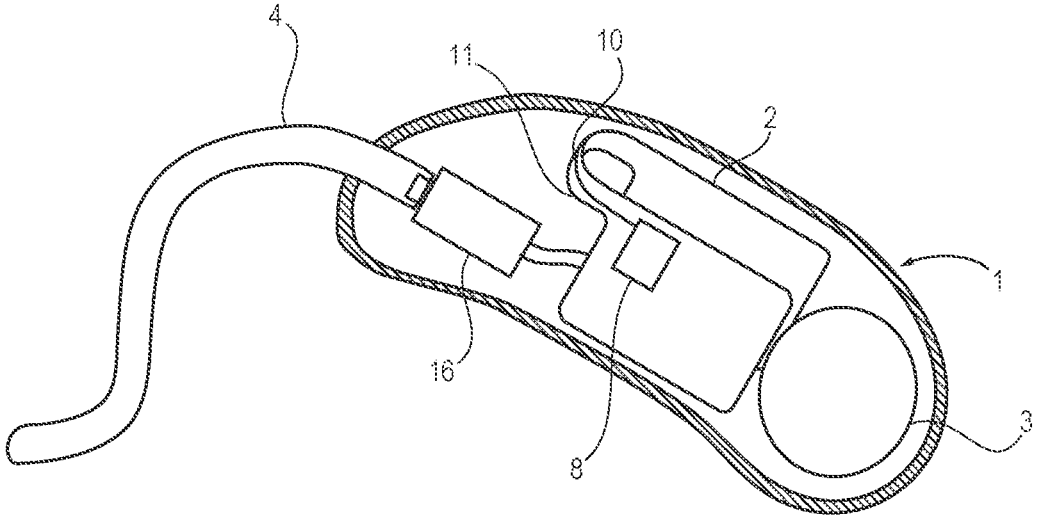
FIG. 6 schematically illustrates an example of a hearing device with a supporting structure arranged inside.

FIG. 6 schematically illustrates an example of a hearing device 1 with a supporting structure 2 arranged inside. The hearing device 1 is shown with parts of the housing cut away to expose a hearing device battery 3, the supporting structure 2 and an acoustic output transducer 16. The hearing device battery 3 supplies power to the hearing device circuit substantially mounted on, or in, the supporting structure 2. The hearing device circuit includes a wireless communication unit 8 connected to a connecting line 10 provided as part of the supporting structure 2. An opening 11 is provided in the supporting structure 2. The hearing device circuit is also connected to the acoustic output transducer 16 for reproducing an audio signal through a sound tube 4 connected thereto, e.g. an audio signal picked up by the hearing device microphone (not shown).

The supporting structure 2 acts as an antenna for the hearing device 1, and allows the wireless communication unit 8 to transmit or receive wireless signals to, and from, external units such as a mobile device, a wireless streaming device or another hearing device with improved quality of the wireless signals when compared with existing antenna configurations. In FIG. 6, the general polarisation direction is substantially perpendicular to the viewing plane, thus particularly facilitating wireless communication with another hearing device placed on the opposite side of the user's head.

Although particular features have been shown and described, it will be understood that they are not intended to limit the claimed invention, and it will be made obvious to those skilled in the art that various changes and modifications may be made without departing from the scope of the claimed invention. The specification and drawings are, accordingly to be regarded in an illustrative rather than restrictive sense. The claimed invention is intended to cover all alternatives, modifications and equivalents.

LIST OF REFERENCES

1 hearing device
2 supporting structure
3 battery
4 sound tube
5 signal wire
6 signal wire
7 electrically conductive ground layer
8 wireless communication unit
9 feed area
10 connecting line
11 opening
12 interconnection of connection line
15 processing unit
16 acoustic output transducer
20 first layer
21 second layer

The invention claimed is:

1. A hearing device comprising:

a microphone configured to receive sound;

a processing unit configured to provide a processed audio signal for compensating for a hearing loss of a user;

a wireless communication unit configured for wireless communication;

a supporting structure;

wherein the supporting structure comprises:

an electrically conductive ground layer, an electrically non-conductive opening, and a connecting line extending from the wireless communication unit, wherein the wireless communication unit is located closer to a first side of the opening than to a second side of the opening, wherein the connecting line extends across or along the opening to the second side of the opening, the connecting line being coupled with the electrically conductive ground layer via a connection that is closer to the second side of the opening than to the first side of the opening; and wherein the electrically conductive ground layer is configured to be excited utilizing the connecting line, whereby the electrically conductive ground layer is configured to act as an antenna; and wherein an impedance of the antenna is based on a length $L_o$ of the opening and/or a distance z between an edge of the opening and the connecting line.

2. The hearing device according to claim 1, wherein the supporting structure has an effective length L and an effective width W, wherein the opening is arranged at a location that is within 0.2 L from a centre part of the supporting structure.

3. The hearing device according to claim 1, wherein the supporting structure comprises a feed area located closer to the first side of the opening than to the second side of the opening, the feed area being coupled with the wireless communication unit.

4. The hearing device according to claim 1, wherein the opening is arranged at a side/edge part of the supporting structure.

5. The hearing device according to claim 1, further comprising a housing accommodating the supporting structure, and wherein the supporting structure is folded or bended.

6. The hearing device according to claim 1, wherein the supporting structure comprises a first portion and a second portion, and wherein the opening is arranged in a third portion between the first portion and the second portion, and wherein, when the supporting structure is folded or bended, the first portion and the second portion are arranged opposite each other.

7. The hearing device according to claim 6, wherein the third portion is configured to be in a direction of an ear-to-ear axis when the hearing device is positioned in an intended operational position at an ear of the user.

8. The hearing device according to claim 1, wherein a majority of the supporting structure is symmetric about a centre part of an effective length L of the supporting structure, and/or about an axis passing through the connecting line and the opening across a width of the supporting structure.

9. The hearing device according to claim 1, wherein the antenna is configured to be polarized by the supporting structure.

10. The hearing device according to claim 9, wherein the antenna is configured to be polarized by the supporting structure for ear-to-ear performance and phone-in-pocket performance.

11. The hearing device according to claim 1, wherein the supporting structure comprises a feed area, and wherein the hearing device further comprises signal wires on the supporting structure, the signal wires being routed across the feed area.

12. The hearing device according to claim 1, wherein the supporting structure is a carrier printed circuit board.

13. The hearing device according to claim 12, wherein the processing unit and the wireless communication unit are arranged in a hybrid, and wherein the hybrid is carried on the printed circuit board.

14. The hearing device according to claim 1, wherein the supporting structure has at least a first layer and a second layer, and wherein the first layer is an electrically conductive layer, the first layer extending over at least 75% of the supporting structure, and wherein the wireless communication unit and the connecting line are at the second layer.

15. The hearing device according to claim 14, wherein the opening is in the first layer.

16. The hearing device according to claim 14, wherein the opening comprises a cut-out in the supporting structure.

17. The hearing device according to claim 16, wherein a length of the cut-out in the supporting structure corresponds to a length of a non-conductive part of the first layer; or wherein the length of the non-conductive part of the first layer is shorter than the length of the cut-out in the supporting structure.

18. The hearing device according to claim 1, wherein the connecting line extends along the length $L_o$ of the opening.

19. The hearing device according to claim 1, connecting line extends across the opening at the distance z from the edge of the opening.

20. The hearing device according to claim 1, wherein a length of the connecting line corresponds to the length of the opening.

21. The hearing device according to claim 20, wherein a difference between the length of the connecting line and the length of the opening is within 10%.

22. The hearing device according to claim 1, wherein an effective length of the supporting structure corresponds to a half wavelength of an electromagnetic field to be emitted and/or received by the antenna.

23. The hearing device according to claim 1, wherein the supporting structure comprises a polarization element for polarizing the antenna.

24. A method performed by a hearing device, the hearing device comprising:

a microphone configured to receive sound;

a processing unit configured to provide a processed audio signal for compensating for a hearing loss of a user;

a wireless communication unit configured for wireless communication;

a supporting structure;

wherein the supporting structure comprises:

an electrically conductive ground layer, an electrically non-conductive opening, and a connecting line extending from the wireless communication unit, wherein the wireless communication unit is located closer to a first side of the opening than to a second side of the opening, wherein the connecting line extends across or along the opening to the second side of the opening, the connecting line being coupled with the electrically conductive ground layer via a connection that is closer to the second side of the opening than to the first side of the opening;

wherein the method comprises utilizing the connecting line to excite the electrically conductive ground layer to cause the electrically conductive ground layer to act as an antenna; and wherein an impedance of the antenna is based on a length $L_o$ of the opening and/or a distance z between an edge of the opening and the connecting line.

* * * * *